US009840027B2

(12) United States Patent
Fritz et al.

(10) Patent No.: US 9,840,027 B2
(45) Date of Patent: Dec. 12, 2017

(54) REVERSIBLE BLADE GUARD ASSEMBLIES

(71) Applicants: David W. Fritz, Cottage Grove, OR (US); Kathryn L. Fritz, Cottage Grove, OR (US)

(72) Inventors: David W. Fritz, Cottage Grove, OR (US); Kathryn L. Fritz, Cottage Grove, OR (US)

( * ) Notice: Subject to any disclaimer, the term of this patent is extended or adjusted under 35 U.S.C. 154(b) by 161 days.

(21) Appl. No.: 15/017,042

(22) Filed: Feb. 5, 2016

(65) Prior Publication Data

US 2017/0225357 A1 Aug. 10, 2017

(51) Int. Cl.
*B28D 1/04* (2006.01)
*B27G 19/02* (2006.01)

(52) U.S. Cl.
CPC ..... *B28D 1/045* (2013.01); *B27G 19/02* (2013.01)

(58) Field of Classification Search
CPC ..... B28D 1/045; B27G 19/02
USPC ..... 451/451–457
See application file for complete search history.

(56) References Cited

U.S. PATENT DOCUMENTS 4,409,699 A * 10/1983 Moorhouse ..... A47L 7/0095 144/252.1
4,738,571 A * 4/1988 Olson ..... B23Q 11/0046 408/67
4,750,536 A * 6/1988 Grisley ..... B23Q 11/0046 144/251.3
4,870,946 A * 10/1989 Long ..... B23D 59/025 125/13.01
5,220,753 A * 6/1993 Whitman ..... B24B 55/10 451/456
7,905,260 B2 * 3/2011 Keenan ..... B23Q 11/0046 144/252.1
7,971,611 B1 * 7/2011 Wells ..... B23Q 11/0046 144/136.95
8,397,342 B2 * 3/2013 Baker ..... B08B 15/04 134/21
2007/0096539 A1 * 5/2007 Walker ..... E01C 23/0933 299/39.3

* cited by examiner

*Primary Examiner* — George Nguyen
(74) *Attorney, Agent, or Firm* — Mohr Intellectual Property Law Solutions, PC

(57) ABSTRACT

Reversible blade guards are disclosed for concrete saws that can be mounted on either side of the saw, and are equipped to quickly be reconfigured depending upon the side of the saw upon which they are mounted. A mechanism for applying pressure to the work surface through a blade shoe is disclosed as part of the blade guard.

17 Claims, 8 Drawing Sheets

REVERSIBLE BLADE GUARD ASSEMBLIES

BACKGROUND

The present disclosure relates generally to blade guard assemblies. In particular, blade guard assemblies for concrete saws that are designed to be reversibly mounted on either side of the saw are described.

The preparation of concrete pads is a common practice in the construction industry. Concrete pads are used in parking lots, roadways, as foundation slabs, in parks, patios, and any number of other building applications. Owing to its water-based nature, concrete naturally shrinks as it cures, due to the loss of water. This shrinking occurs first at the surface of the concrete, which is the location of water evaporation. Consequently, left to cure untended, concrete pads of sufficiently large size will develop cracks as they dry, which can compromise the concrete's integrity and mar an otherwise smooth surface.

One solution to prevent cracking during the curing process is to cut expansion gaps into the concrete surface early in the curing process, known as early entry cutting. These expansion gaps provide a space for surface tension to be relieved as the concrete further shrinks, thereby preventing cracks from developing in the slab. The concrete is typically cut from ¼ to ⅓rd of its depth. The timing of the cutting is critical; the concrete must cure sufficiently to withstand the weight of the concrete saw without marring its surface, but not have dried to the point where a saw requires water for cutting, or has begun to crack. Concrete at this point is known as green. Although a diamond masonry blade is used, due to the concrete still having relatively high water content, a saw cutting green concrete does not need water. As the concrete lacks the strength of fully cured concrete, the concrete saw must provide pressure against the concrete work surface immediately adjacent to the blade kerf to prevent spalling of the sides of the crack.

This pressure is supplied by a blade guard assembly attached to the concrete saw that houses the saw blade. The blade guard assembly also serves a safety function by substantially enclosing the rotating saw blade, and by channeling dust from the cutting action to keep the surrounding work area clear from the potential formation of dust clouds. The blade guard is typically immovably affixed to the concrete saw at the end of a drive shaft, to which is attached an arbor, to which the saw blade is further attached.

Known blade guard assemblies are not entirely satisfactory for the range of applications in which they are employed. For example, existing blade guard assemblies used on concrete saws employed in early entry applications are typically capable of being mounted on only one side of the saw. As concrete saws are bulky, walk-behind machines, having the blade assembly able to mount on only one side of a machine can pose problems on certain projects, such as when surrounding obstacles may prevent saw movement or not provide proper support for a clean cut. Often, being able to relocate the blade assembly to the opposite side of the machine will easily remedy these situations. The design of known blade guard assemblies tends to be unidirectional; mounting the blade guard on the opposite side of a machine may result in improper work surface contact and potential damage to the saw blade and green concrete. Consequently, operators of a saw that can accept a blade assembly on either side typically must carry a separate blade guard specific for each side of the machine, which increases costs.

A crucial part of the blade guard assembly is the blade shoe, through which the saw blade passes. The blade shoe serves as the contact point between the blade guard assembly and the work surface, and is the means by which pressure is applied to the work surface surrounding the blade kerf during cutting. The typical blade shoe configuration is substantially an elongated rectangular plate, with a centrally located slot through which the blade passes. Pressure supplied via the weight of the concrete saw and associated pressure devices is transmitted through the blade shoe to the work surface immediately surrounding the blade kerf.

In operation of the concrete saw, the blade shoe is subject to wear over time, which degrades both cut quality and blade life. As the concrete saw is moved forward in operation, the blade shoe slides upon the surface to maintain appropriate pressure. The blade cutting action generates dust, which is cleared from the cut primarily at the point where the blade rotates up out of the kerf. Depending on blade rotation, this point will be at either of the ends of the centrally located slot. This generated dust is abrasive in nature and, consequently, results in end of the centrally located slot wearing substantially faster than other portions of the slot, this wear being expressed as a noticeable widening of the slot. The widened slot, in turn, reduces the amount of pressure placed on the work surface immediately around the point where the blade is retreating from the work surface. Due to the retreating blade and dust ejection, this point is where opposing forces from the cutting action are at a maximum, and a slot that is widened due to wear is unable to effectively oppose these forces where they are immediately experienced. As a result, spalling of the work surface occurs, and due to the rougher cut, blade wear is increased with a commensurate decrease in blade life. Because the blade shoe is typically a single piece of cast or forged metal, a worn blade shoe must be replaced as a single piece, often at an elevated cost. Costs are further elevated by the fact that the blade and the shoe typically are replaced as a set; if the blade shoe wears, the blade must also be replaced, even if the blade would otherwise still have useful life.

Thus, there exists a need for blade guard assemblies and improved blade shoe designs that improve upon and advance the design of known blade guard assemblies and blade shoes. Examples of new and useful blade guard assemblies and blade shoes relevant to the needs existing in the field are discussed below.

Disclosure addressing one or more of the identified existing needs is provided in the detailed description below. Examples of references relevant to blade guard assemblies and blade shoes include U.S. Pat. No. 8,276,578. The complete disclosures of the above patents and patent applications are herein incorporated by reference for all purposes.

SUMMARY

The present disclosure is directed to a reversible blade guard for a concrete saw that can be mounted on either side of the saw, and is equipped to quickly be reconfigured depending upon the side of the saw upon which it is mounted. A mechanism for applying pressure to the work surface through a blade shoe is disclosed as part of the blade guard. In addition to allowing for truck reconfiguration of the blade guard as appropriate, the pivoting attachment points between the blade housing and the blade shoe aid in providing consistent pressure upon the work surface, even over minor surface irregularities.

DETAILED DESCRIPTION

The disclosed reversible blade guard assemblies will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various reversible blade guard assemblies are provided. Related features in the examples may be identical, similar, or dissimilar in different examples. For the sake of brevity, related features will not be redundantly explained each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1A:
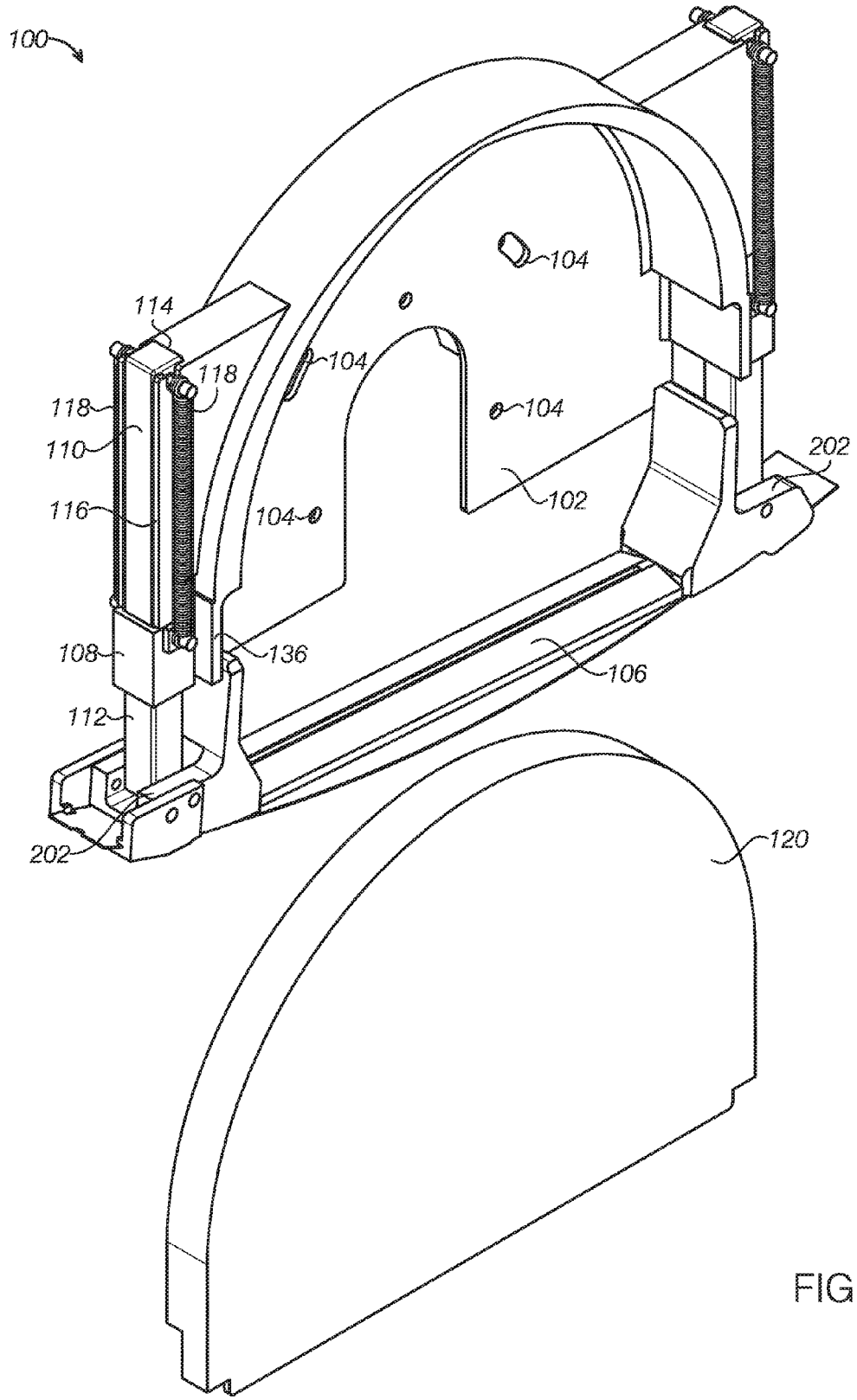
FIG. 1A is a perspective view of an example blade guard assembly, showing the blade shoe in place and the cover to one.

With reference to FIGS. 1A-_, an example of a reversible blade guard assembly, blade guard 100, will now be described. Blade guard 100 functions to provide a blade guard that can be reversibly mounted on either side of a concrete saw that is equipped to receive a guard on either side, requiring only minimal reconfiguration by reversing the direction of the blade shoe, if the blade shoe is not symmetrical. The reader will appreciate from the figures and description below that blade guard 100 addresses shortcomings of conventional blade guard assemblies.

For example and as can be seen in the figures, blade guard 100 can be mounted on either side of a concrete saw equipped with suitable mounting points. This is facilitated by the blade guard's substantially symmetrical configuration, with a tension mechanism on either end that maintains a downward pressure of the blade shoe. The blade shoe attaches to blade guard 100 by two detachable pivot points associated with each tension mechanism, thereby allowing the blade shoe, which may be unidirectional, to be mounted facing either direction, depending upon the side of concrete saw upon which blade guard 100 is attached. Thus, blade guard 100 can be swapped between sides of a concrete saw with a minimal amount of reconfiguration and no required additional side-specific parts, while suffering no diminishment of functionality.

Blade guard 100 is attached to a concrete saw and enshrouds a concrete cutting saw blade 130, which passes through a blade shoe. When mounted properly, blade guard 100 helps to contain and channel cutting dust and residue, apply appropriate pressure to the work surface so as to facilitate a clean cut, and extend the useable life of the saw blade. As will be described below, blade guard 100 in conjunction with the blade shoe includes a series of flanges that help to better contain dust and neatly channel it to the sides of the blade kerf.

Figure 1B:
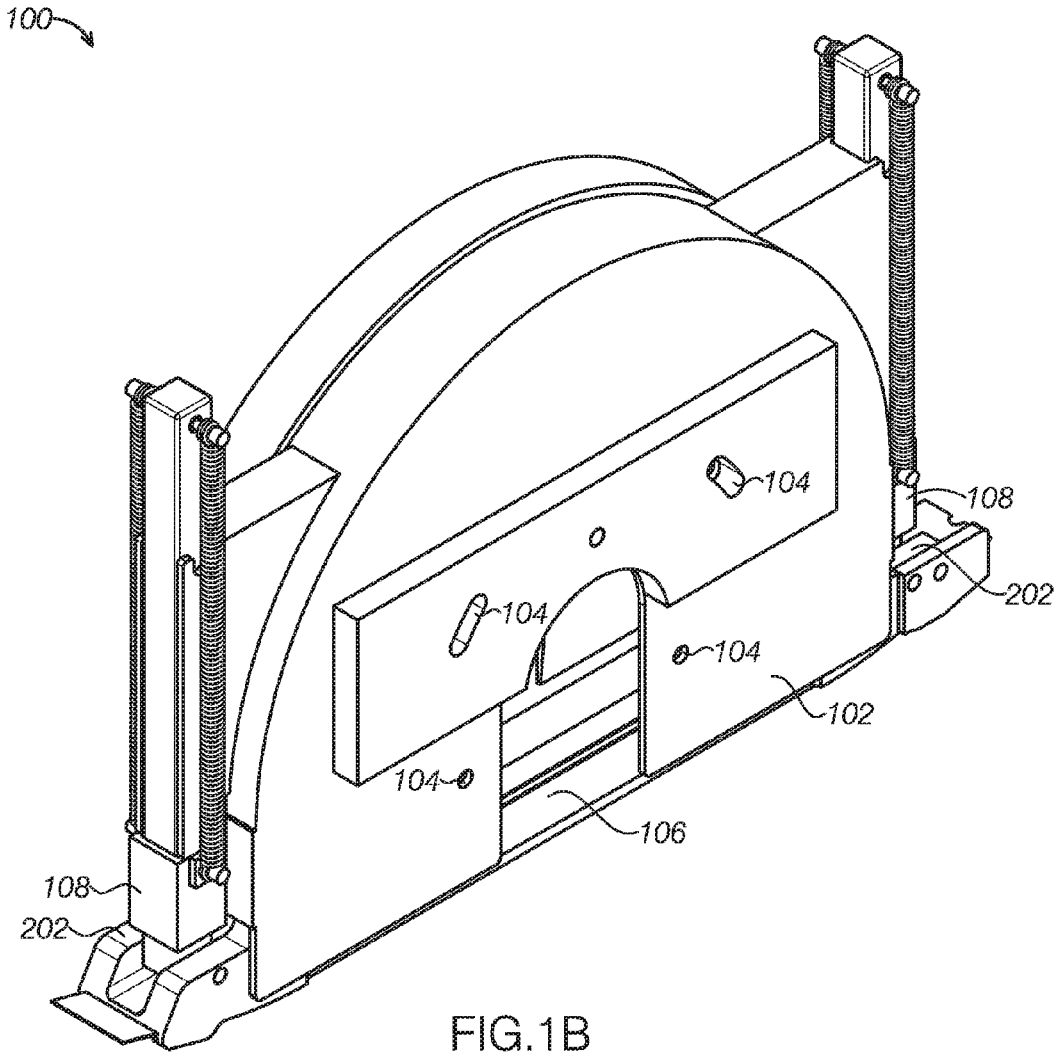
FIG. 1B is a perspective view showing the back side of the blade guard assembly depicted in FIG. 1A.

In FIGS. 1A-B reversible blade guard 100 is comprised of a blade housing 102 that includes a plurality of attachment points 104 for mounting blade housing 102 to a concrete saw. A blade shoe 106 is attached to blade housing 102 via a plurality of connectors 108 attached to and extending from blade housing 102. Connectors 108 allow blade shoe 106 to be removably affixed to blade housing 102, wherein each of plurality of connectors 108 removably attaches to blade shoe 106 in a pivotable fashion such that blade shoe 106 can rotate within the plane of blade housing 102. Each connector 108 allows blade shoe 106 to slide within the plane of blade housing 102 so as to increase or decrease distance from blade housing 102, and applies pressure against blade shoe 106 as it slides towards blade housing 102. Importantly, the attachment points 104 and plurality of connectors 108 allow the blade guard assembly to be reversibly mounted. Mating with blade housing 102 is cover 120, which in conjunction with blade housing 102 encloses a substantial portion of saw blade 130.

Figure 2:
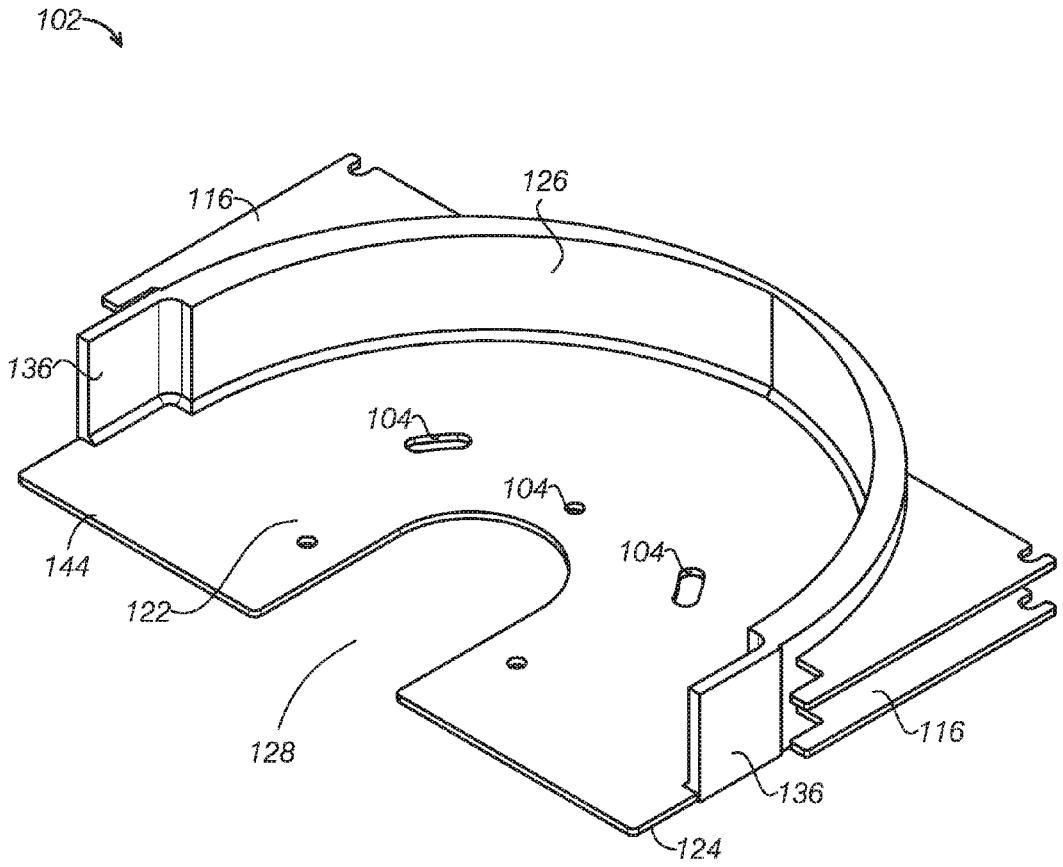
FIG. 2 is a perspective view of the blade housing and base plate of blade guard assembly depicted in FIGS. 1A and 1B.

As can be seen in FIG. 2, blade housing 102 is comprised of a base plate 122 that is preferably semicircular in shape, with a perimeter edge 124, and a flange 126 disposed upon at least part of perimeter edge 124. Although perimeter edge 124 and associated flange 126 are depicted as semicircular in the figures, a person skilled in the relevant art will understand that any shape suitable for containing the saw blade can be utilized, such as a square or polygon. A notch 128 is provided in base plate 122 that extends inward from perimeter edge 124 and is positioned so as to allow a circular saw blade 130 to be mounted on an arbor within blade housing 102. Alternatively and depending on the concrete saw being used, notch 128 can be instead implemented as a hole large enough to pass through the blade arbor, in which case the hole can be disposed in base plate 122 away from the perimeter edge.

In the preferred embodiment and as can be seen in FIG. 2, base plate 122 is shaped roughly like half of a saw blade 130, so as to conform to the profile of a blade. Thus, as illustrated in the figures base plate 122 has a semicircular perimeter edge 124 that intersects with a straight perimeter edge 144. As described in the foregoing paragraph, suitable shapes other than a semicircle could be utilized, and the shape of base plate 122 would be defined by the shape of perimeter edge 124. Notch 128 preferably bisects and extends from the straight perimeter edge. Base plate 122, along with flange 126, can be manufactured from metal, plastic, wood, composites, or any other suitably rigid material now known or later developed. Base plate 122 and flange 126 can be manufactured from the same or differing materials.

Flange 126 is attached to semicircular perimeter edge 124 of base plate 122 on one side, and extends from base plate 122 perpendicularly in a direction away from the concrete saw. Flange 126 also may extend past the two points where semicircular perimeter edge 124 intersects with the straight perimeter edge 144, so as to form two protrusions 136 that extend downward past base plate 122 towards blade shoe 106. Flange 126 can either be molded as an integral part of base plate 122 during forming, be fabricated from an appropriate long rectangular strip that is attached on one long side to perimeter edge 124, or in any other fashion known in the art or later developed. Flange 126 can be attached by welding, glue, or other mechanical fastening means such as rivets, screws, press-fitting, folding over of a second flange, or any other suitable means of attachment. Flange 126 can be manufactured from the same or a different material as base plate 122.

Although the figures depict protrusions 136 as being integral with flange 126, protrusions 136 can also be implemented as separate mountable components that are secured to the ends of flange 126 by screws, welds, adhesives, clamps, or any other temporary or permanent method of affixation.

Attachment points 104 are typically located on base plate 122, and may be as simple as a series of holes for passing through mounting bolts that attach into the underlying mounting structure on the receiving concrete saw. Alternatively, attachment points 104 may be hooks, notches, recesses, clamps, or any other appropriate mechanism that allows blade guard 100 to be removably attached to a receiving concrete saw. The number and type of attachment points 104 will vary depending on the saw model, or some blade guards 100 could be equipped with several types of attachment points 104 to allow them to be used with a number of different saw models. Attachment points 104 will preferably allow blade guard 100 to securely be attached to a stationary structure on the receiving concrete saw, such as the saw frame, although the structure of the concrete saw to which blade guard 100 is attached may vary depending on the saw model and intended use. Still further, attachment points 104 could mate with an intermediate adapter that would enable blade guard 100 to be mounted to any type of saw via an appropriately configured adapter. In such an arrangement, a single blade guard 100 could be made for a universal fit, with only different adapters needed depending on the selected saw model. Attachment points 104 may, as applications require, be located on components or blade guard 100 other than base plate 122.

In the preferred embodiment, blade guard 100 has two connectors 108, with each connector 108 attached on either end of blade housing 102. Connectors 108 serve to hold blade shoe 106 in proper position relative to blade housing 102 and a saw blade mounted therein and, in conjunction with tensioning devices 118, transmit force to keep blade shoe 106 under pressured contact with a work surface. Connectors 108 are designed to cooperate with corresponding mount points 202 on blade shoe 106 to provide a pivot point at each mount point 202, thereby allowing blade shoe 106 to ride over possible work surface irregularities. While the preferred embodiment has two connectors, it will be appreciated by a person skilled in the relevant art that alternative configurations having more than two connectors, or potentially one connector, could be implemented depending on the specific application needs, without departing from the disclosed invention.

In the example shown in FIG. 1A, each connector 108 is further comprised of a shaft 110 having a first end 112 that removably and pivotably attaches to blade shoe 106, and a second end 114. A corresponding keyway 116 is attached to blade housing 102 and receives second end 114 of shaft 110 such that shaft 110 is capable of sliding axially through keyway 116 and is substantially prevented from moving laterally with respect to keyway 116. A tensioning device 118 is removably affixed to both shaft 110 and keyway 116 such that force is applied against shaft 110 as it moves within keyway 116. Specifically, as shaft 110 moves inward through keyway 116 in the direction of blade housing 102, tensioning device 118 applies force resistive of the movement, urging shaft 110 to move away from blade housing 102, and thereby creating pressure between blade shoe 106 and the work surface to be cut.

In the figures, tensioning device 118 is depicted in its preferred implementation as a plurality of springs, with two springs per connector 108. The type of spring should be selected with the goal of maintaining sufficient pressure by blade shoe 106 against the work surface so as to prevent spalling, but not so great a pressure that a green concrete surface is marred, or travel of the concrete saw is impeded. Furthermore, connector 108 could be configured so as to allow adjustable tension, to accommodate potential variations in work surface or job requirements. Such adjustment mechanisms could include provisions to remove or attach additional springs, or an adjustment knob for pretensioning the springs.

A person skilled in the relevant art will also appreciate that many possible implementations of tensioning device 118 are possible without departing from the disclosed invention. Possible variations include more or fewer springs, or different types of pressure or tension devices such as gas cylinders or struts, spring cartridges, or any other method of applying pressure in response to linear movement now known or later developed. Depending on how tensioning device 118 is implemented, it will be understood by a person skilled in the relevant art that connector 108 may lack a number of the various aforementioned components of connector 108, as tensioning device 118 may implement the functionality of the various components in a different fashion. Such varying implementations do not depart from the disclosed invention. Any varying implementation will be expected to at least have some version of a first end 112 that offers a connection point to blade shoe 106.

Figure 3:
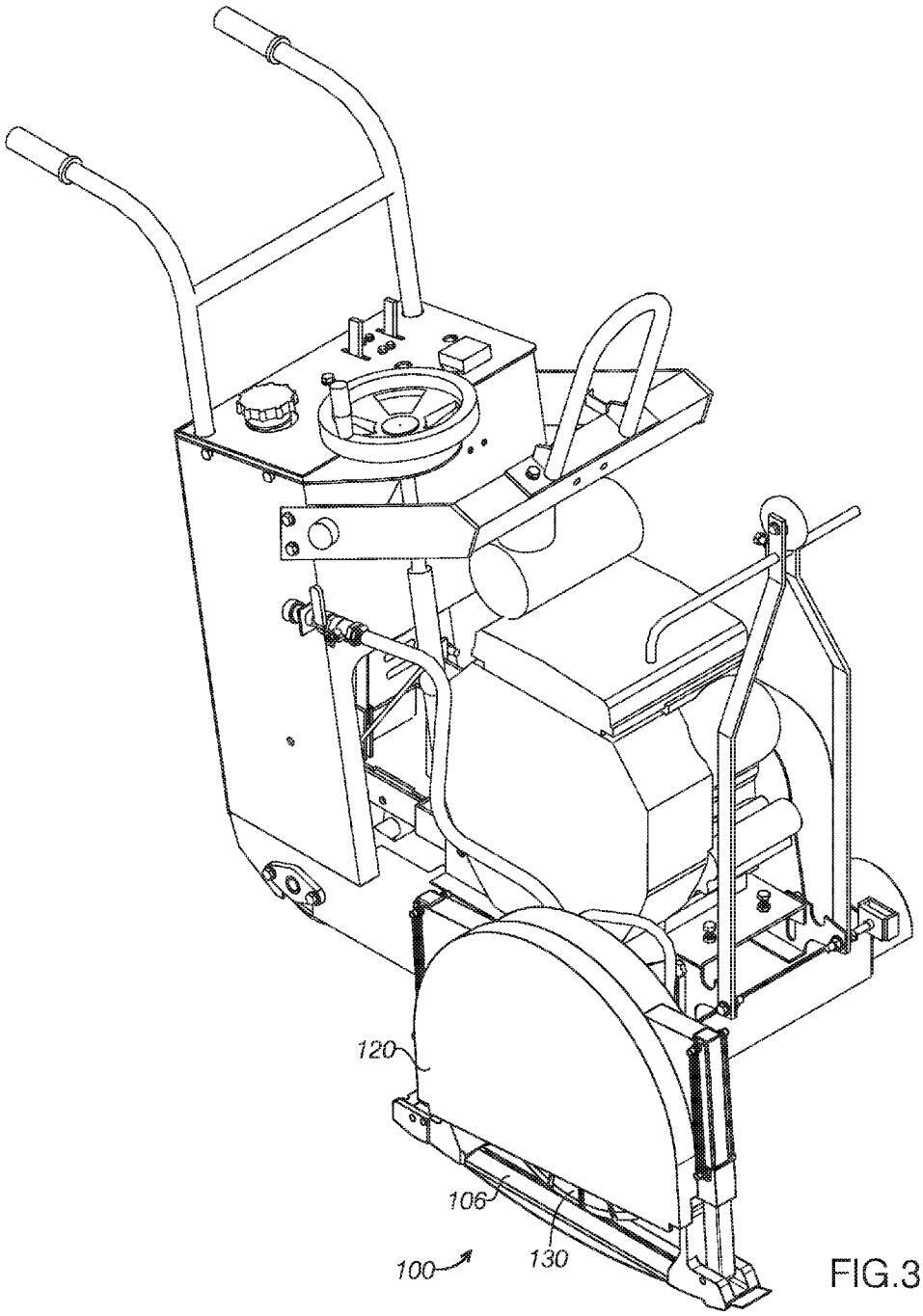
FIG. 3 is a perspective view showing the blade guard assembly depicted in FIGS. 1A and 1B attached to a concrete saw, with the cover in place.
Figure 4:
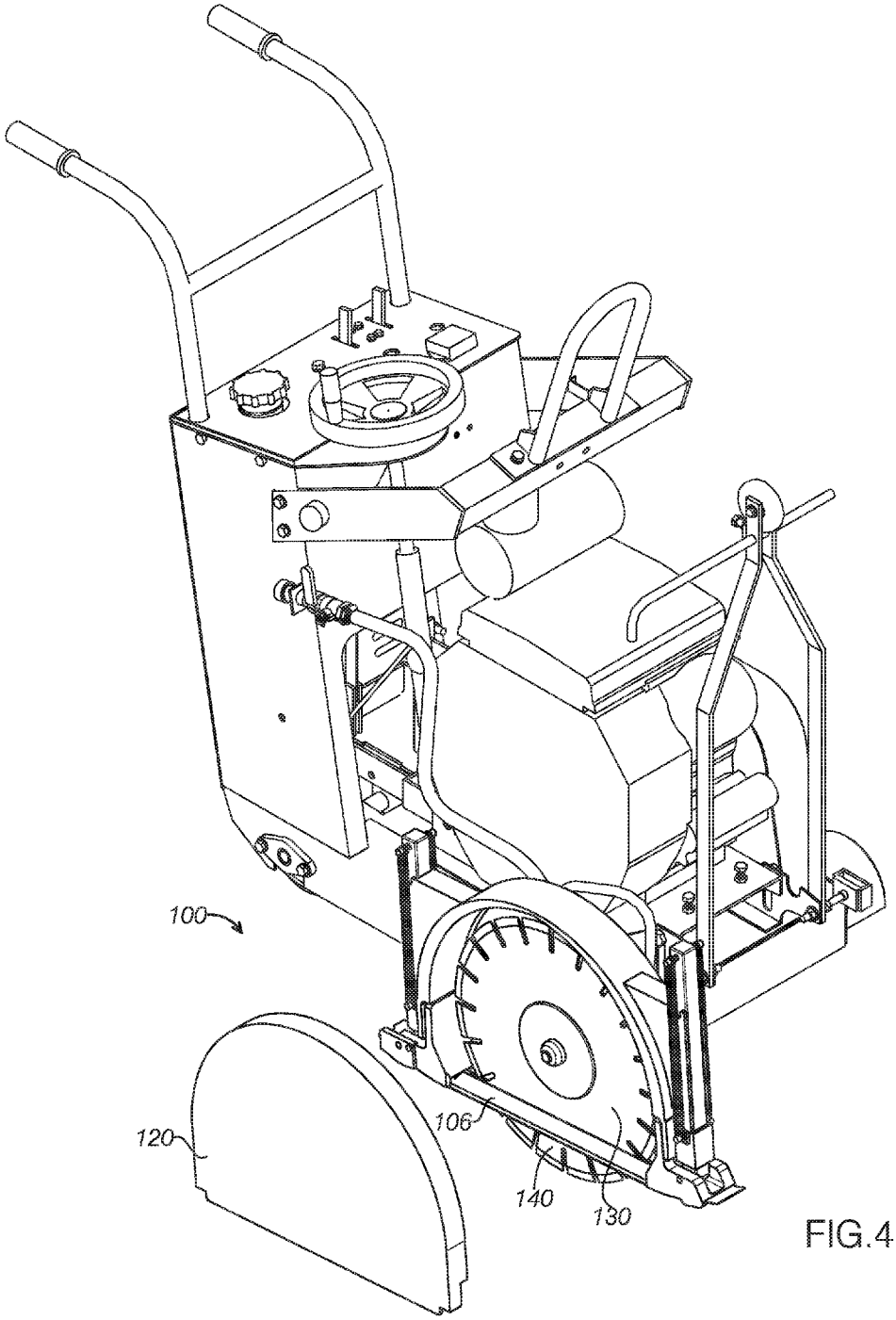
FIG. 4 is a perspective view showing the blade guard assembly depicted in FIG. 3 with the cover removed, showing the saw blade in place within the blade guard assembly.
Figure 5:
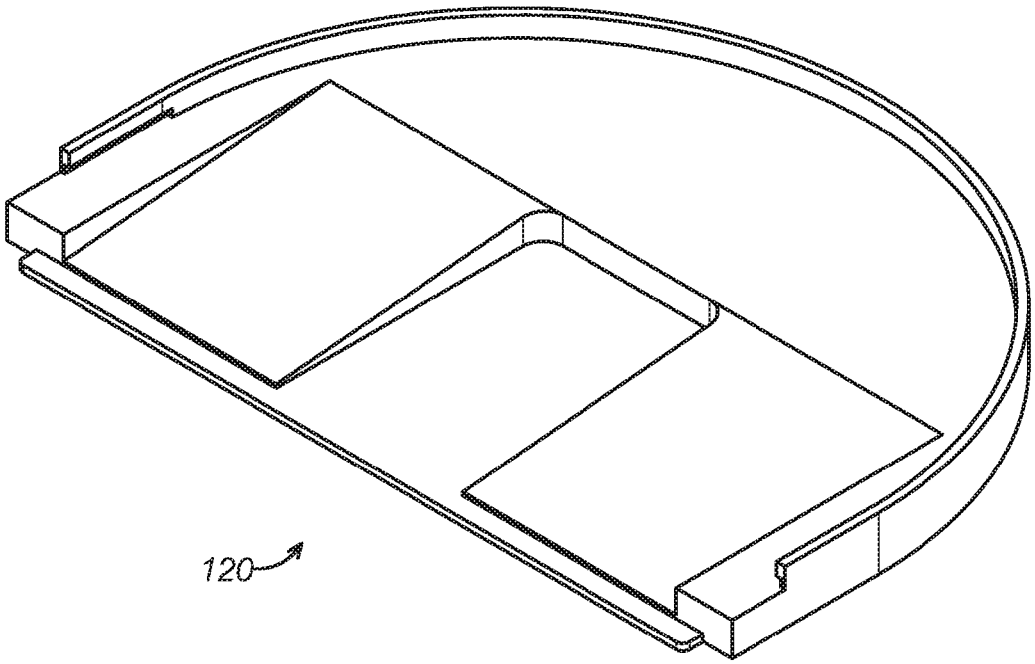
FIG. 5 is a perspective view showing the cover for the blade guard assembly depicted in FIGS. 1A and 1B.

FIGS. 3 and 4 depict blade guard 100 as attached to a concrete saw. FIG. 3 depicts blade guard 100 with cover 120 in place over blade housing 102, while FIG. 4 depicts cover 120 removed and blade 130 visible. FIG. 5 depicts cover 120 that fits over blade housing 102 to enclose saw blade 130 in greater detail. As can be seen in the figures, the shape defined by cover 120 generally corresponds to the shape defined by flange 126 so that base plate 122, flange 126 and cover 120 all cooperate to substantially enclose saw blade 130. Cover 120 can be manufactured from the same general types of materials as blade housing 102, and need not be of the same type of material. Such materials include metal, plastics, wood, composites, or any other suitable material.

Figure 6A:
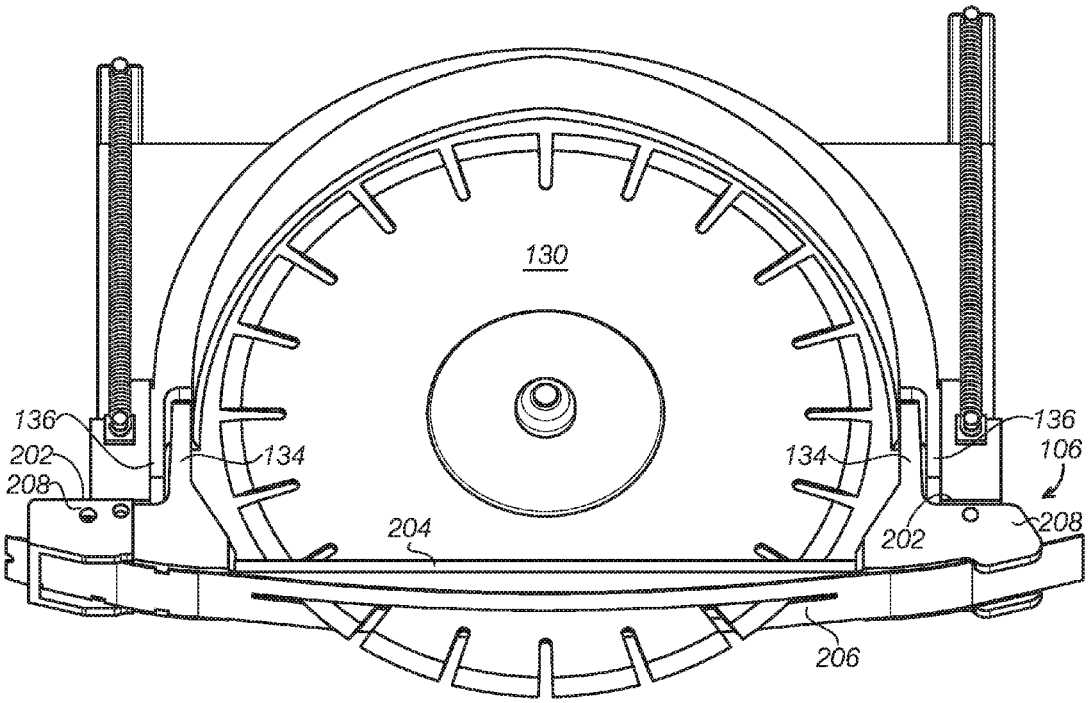
FIG. 6A is a perspective view showing the blade shoe assembly as it interfaces with the blade guard assembly depicted in FIGS. 1A and 1B.
Figure 6B:
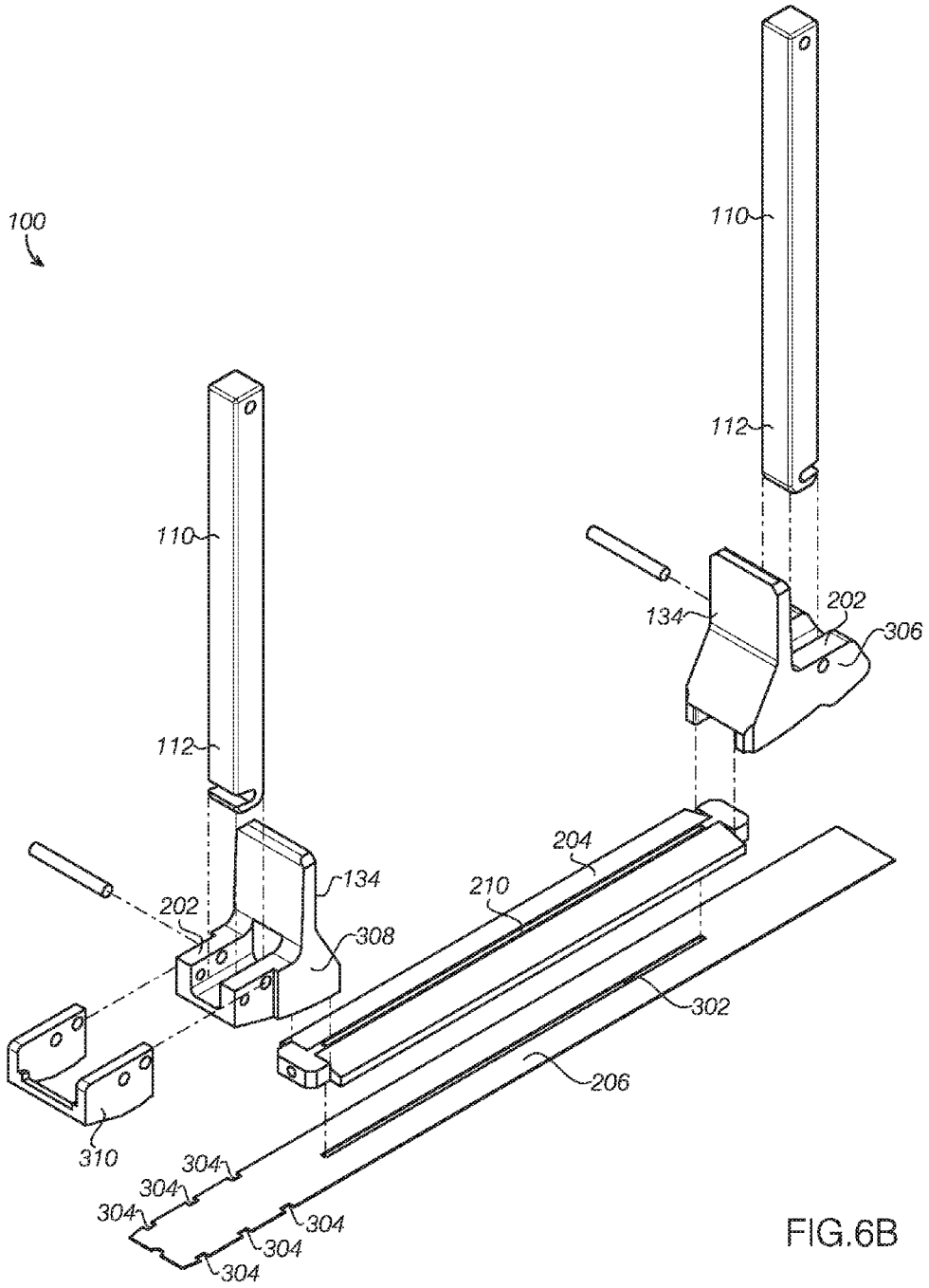
FIG. 6B is an exploded view of the blade shoe assembly depicted in FIG. 6A.

Referring to FIGS. 6A and 6B, blade shoe 106 improves upon existing blade shoe designs by employing a spring plate 206 that removably attaches to a backing plate 204, in contrast to the existing approach of using a single cast, forged, or machined plate. The spring plate, when mounted to the backing plate, presents a convex shape that compresses upon lowering to the work surface, thereby adding additional even pressure across the work surface immediately adjacent to the blade kerf. Furthermore, owing to its flexibility, the spring plate can better conform to surface irregularities (such as rises, ridges dips, and crowns) that are smaller than the length of blade shoe 106. The prior art blade shoe would simply ride over these irregularities, resulting in varying amounts of pressure being applied to the work surface, and increasing the chance of spalling. The conforming spring plate ensures a more consistent pressure over these surface irregularities.

Additionally, the spring plate presents the surface in direct contract with the work surface, as opposed to the backing plate. The spring plate is preferably manufactured from less expensive materials, is overall less expensive due to less material utilized, and will wear first while substantially preserving the backing plate. The spring plate can preferably be adjusted in position so as to allow repositioning of the spring plate as it wears, thereby extending the useful life of the spring plate. Once the spring plate can no longer be repositioned to maintain functionality, it can be replaced without the need to replace the entire blade shoe 106 assembly.

As can be seen in FIGS. 6A and 6B, blade shoe 106 is comprised of a backing plate 204, to which is removably mounted a spring plate 206 that contacts the work surface. Backing plate 204 is roughly rectangular in shape, with at least one mounting point 208 affixed on either end. Centered along the longitudinal axis of blade shoe 106 is blade slot 210, through which the saw blade passes into the work surface. Mounting points 208 interface with connectors 108 for mounting on blade guard 100. Backing plate 204 is constructed from any suitable material that is capable of sustaining the downward pressure placed by the concrete saw in use upon the work surface. Suitable materials include aluminum, steel, plastics, composites, or any other similarly suitable material now known or later developed.

Spring plate 206 has a centrally located slot 302 sized so as to receive a saw blade, and located along the longitudinal axis of spring plate 206. One end of spring plate 206 possesses a plurality of notch sets 304. Spring plate 206 removably mounts to backing plate 204 via a slot on one end of backing plate 204 provided by one mounting point 208, and a catch on the other end of backing plate 204 presented by the opposing mounting point 208 located longitudinally distal from the slot that engages a corresponding notch set 304. The details of each mounting point 208 will be described in greater detail below. The slot and catch mechanism together center spring plate 206 along the longitudinal axis of backing plate 204 so that centrally located slot 302 lines up with corresponding blade slot 210 on backing plate 204. Plurality of notch sets 304 are positioned on spring plate 206 such that the slot and catch mechanism retain spring plate 206 in a flexed condition, so as to cause spring plate 206 to exert pressure upon a work surface when compressed by lowering the concrete saw.

Turning to FIGS. 6A and 6B, the details of blade shoe 106, and specifically preferred implementation of the aforementioned slot and catch mechanism, are shown. On the leading end of backing plate 204 is an attachment point receiver 306, which is slotted to receive a hook on first end 112. By using a slot and hook configuration, it can be seen that blade shoe 106 is pivotably attached to first end 112; that is, blade shoe 106 can rotate about first end 112 within the plane of blade housing 102 and saw blade 130. Receiver 306 fits upon one end of backing plate 204, and includes a slot to retain the front end of spring plate 206. On the trailing end of spring plate 206 is a combination of second attachment point receiver 308 along with a spring plate retention fitting 310. Receiver 308, like receiver 306, includes a slot to receive a hook on first end 112 to facilitate a pivoting mounting point. Receiver 308 is also sized to slidably receive spring plate retention fitting 310. Notch sets 304 engage against spring plate retention fitting 310 to securely retain spring plate 206 is a semi-compressed state. Receiver 306, receiver 308, and spring plate retention fitting 310 are all manufactured out of materials similar to backing plate 204, such as metal, plastic, composites, or any other suitable material now known or later developed that is capable of withstanding the pressures and forces exerted during concrete saw operation.

Receivers 306 and 308 each include an opposing protrusion 134 that is disposed adjacent to corresponding protrusions 136 from flange 126. The combination of opposing protrusions 134 and protrusions 136, together with blade housing 102, combine to substantially completely enclose saw blade 130 while the concrete saw is in operation. The combination of protrusions also serves to keep cutting dust away from attachment points 108, so that tensioning devices 118 are able to provide a consistent pressure to blade shoe 106. Opposing protrusions 134 can either be integral with receivers 306 and 308, or separate pieces that are attached to receivers 306 and 308. Where opposing protrusions 134 are separate pieces, they can be attached to receivers 306 and 308 either removably or permanently, in the same ways in which protrusions 136 may be attached to flange 126.

It will be appreciated by a person skilled in the relevant arts that the combination of receivers 306 and 308, and spring plate retention fitting 310, are one possible method of mounting blade shoe 106 to blade housing 102, and retaining spring plate 206. Any device that allows blade shoe 106 to pivotably mount to blade housing 102, and can retain spring plate 206 in a semi-compressed fashion, will work equally well and is not a departure from the disclosed invention. Furthermore, while spring plate retention fitting 310 is depicted as a separate piece that interfaces with receiver 308, spring plate retention fitting 310 could be integral with receiver 308, formed by a single piece for receiver 308.

Spring plate 206 is preferably manufactured out of spring steel, but can be manufactured from any suitable material that is capable pliable so that it can be retained under stress without breaking, and will exert a force when compressed. Such materials may include metals, plastics, rubbers, and composites, or other materials possessing the requisite properties now known or later developed.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A reversible blade guard assembly, comprising:
a blade housing;
a plurality of attachment points for mounting the blade housing;
a blade shoe; and
a plurality of connectors attached to and extending from the blade housing that allow the blade shoe to be removably affixed to the blade housing, wherein each of the plurality of connectors:
removably attaches to the blade shoe in a pivotable fashion such that the blade shoe can rotate within the plane of the blade housing,
allows the blade shoe to slide within the plane of the blade housing so as to increase or decrease distance from the blade housing, and
applies tension against the blade shoe as it slides towards the blade housing; and
wherein the attachment points and plurality of connectors allow the blade guard assembly to be reversibly mounted.

2. The blade guard assembly of claim 1, wherein each of the plurality of connectors further comprised of:
a shaft having a first end that removably and pivotably attaches to the blade shoe, and a second end;
a keyway that is attached to the blade housing and receives the second end of the shaft such that the shaft is capable of sliding axially through the keyway and is substantially prevented from moving laterally with respect to the keyway; and
a tensioning device removably affixed to both the shaft and the keyway such that tension is applied against the shaft as it moves within the keyway.

3. The blade guard assembly of claim 2, wherein the tensioning device is further comprised of one or more springs.

4. The blade guard assembly of claim 1, further comprising a cover that fits substantially over the blade housing.

5. The blade guard assembly of claim 1, wherein the blade housing further comprises a base plate that is semicircular in shape, with:
a perimeter edge,
a flange disposed upon at least part of the perimeter edge, and
a notch extending inward from the perimeter edge and positioned so as to allow a saw blade to be mounted on an arbor within the blade housing.

6. The blade guard assembly of claim 5, wherein:
the part of the perimeter edge upon which the flange is disposed is curved, and meets a second part of the perimeter edge not disposed to the flange;
the flange extends away from the base plate from where the curved part of the perimeter edge meets the second part of the perimeter edge so as to form two opposing protrusions; and
the blade shoe includes two protrusions, each extending towards one of the two opposing protrusions, wherein each of the two protrusions and its corresponding opposing protrusion overlap.

7. The blade guard assembly of claim 1, wherein each of the plurality of connectors applies tension by means of a spring partridge.

8. The blade guard assembly of claim 1, wherein the blade shoe is substantially rectangular in shape, elongated across the width of the blade housing, and attaches to the blade housing at the ends of the elongation.

9. The blade guard assembly of claim 8, wherein each end of the elongation is curved.

10. A blade guard assembly, comprising:
a blade housing that is semicircular in shape, substantially symmetrical in one plane and has an outward facing surface, possessing one or more attachment points for removably securing the blade housing to a saw with the outward facing surface directed away from the saw regardless of the side of the saw upon which the blade housing is mounted;
a plurality of attachment points disposed upon the blade housing that allow a blade shoe to be removably attached to the blade housing, with each attachment point allowing the blade shoe to slide within a plane defined by a saw blade contained within the blade housing; and
a tensioning device associated with each of the plurality of attachments points that applies an opposing force against the blade shoe as it slides proximate to the blade housing.

11. The blade guard assembly of claim 10, further comprising a cover that substantially pairs with the blade housing so as to substantially enclose a saw blade contained within the blade housing.

12. The blade guard of claim 10, wherein the blade housing further comprises:
a base plate with a semicircular curved perimeter and a substantially straight perimeter disposed between the ends of the semicircular curved perimeter;
a flange disposed around the semicircular curved perimeter and extending perpendicular from a plane defined by the base plate; and
a notch extending from the substantially straight perimeter inward into the base plate and sized to receive a saw blade arbor;
wherein the base plate is sized so that a portion of a saw blade installed upon the saw blade arbor extends past the substantially straight perimeter.

13. The blade guard of claim 12, wherein the plurality of attachment points are affixed to the flange.

14. The blade guard of claim 13, wherein each of the plurality of attachment points further comprises:
a shaft having a first end that removably and pivotably attaches to the blade shoe, and a second end; and
a substantially tubular keyway with a first opening and a second opening, shaped to receive the shaft, that is attached to the blade housing and receives the second end of the shaft into the first opening such that the shaft is capable of sliding axially through the keyway and is substantially prevented from moving laterally with respect to the keyway.

15. The blade guard of claim 14, wherein each tensioning device further comprises a spring with two ends, one end being located proximate to the first end of the shaft and being attached to the keyway, the opposing end being located distally from the first end of the shaft and attaching to the second end of the shaft which protrudes from the second opening of the keyway.

16. The blade guard of claim 14, wherein the blade housing, shafts, and associated keyways are sized such that a portion of a saw blade contained within the blade housing extends through a slot located in the center of the blade shoe.

17. The blade guard of claim 12, further comprising a cover that removably attaches to the flange and is sized similar to the size of the base plate.

* * * * *